US006398585B1

(12) United States Patent
Fukuda

(10) Patent No.: US 6,398,585 B1
(45) Date of Patent: Jun. 4, 2002

(54) WATERPROOF CONNECTOR AND WATERPROOFING METHOD

(75) Inventor: Masaru Fukuda, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/281,045

(22) Filed: Mar. 30, 1999

(30) Foreign Application Priority Data

Mar. 31, 1998 (JP) ..... 10-087124

(51) Int. Cl.[7] ..... H01R 13/40
(52) U.S. Cl. ..... 439/587
(58) Field of Search ..... 439/587, 275, 439/274, 598, 279, 523, 456, 459

(56) References Cited

U.S. PATENT DOCUMENTS

| | | | | |
|---|---|---|---|---|
| 3,879,239 | A | 4/1975 | Rager et al. | 156/73.1 |
| 4,083,902 | A | 4/1978 | Clyde | 264/26 |
| 4,640,567 | A | 2/1987 | Lundergan et al. | 339/94 M |
| 4,643,506 | A | 2/1987 | Kobler | 339/94 |
| 4,662,629 | A | 5/1987 | Plovie | 272/62 |
| 4,662,692 | A | 5/1987 | Uken et al. | |
| 4,684,187 | A | 8/1987 | Rudy, Jr. et al. | |
| 4,708,662 | A | 11/1987 | Klein | 439/353 |
| 4,713,021 | A | 12/1987 | Kobler | 439/272 |
| 4,776,813 | A | 10/1988 | Wilson et al. | 439/587 |
| 4,944,688 | A | 7/1990 | Lundergan | 439/275 |
| 4,969,260 | A | 11/1990 | Kando et al. | 29/863 |
| 4,976,634 | A | 12/1990 | Green et al. | 439/589 |
| 4,979,913 | A | 12/1990 | Aiello et al. | 439/596 |
| 5,023,402 | A | 6/1991 | King, Jr. et al. | 439/447 |
| 5,116,236 | A | 5/1992 | Colleran et al. | 439/271 |
| 5,120,269 | A | 6/1992 | Endo et al. | 439/752 |
| 5,215,635 | A | 6/1993 | Stein et al. | 204/157.62 |
| 5,240,431 | A | 8/1993 | Yagi et al. | 439/271 |
| 5,266,045 | A | 11/1993 | Yamamoto et al. | 439/275 |
| 5,316,504 | A | 5/1994 | Jinno | 439/752 |
| 5,419,722 | A | 5/1995 | Onoda | 439/752 |
| 5,490,572 | A | 2/1996 | Tajiri et al. | 180/65.1 |
| 5,498,170 | A | 3/1996 | Tanaka | 439/271 |
| 5,529,508 | A | 6/1996 | Chiotis et al. | 439/204 |
| 5,562,477 | A | 10/1996 | Moore et al. | 439/383 |
| 5,569,050 | A | 10/1996 | Lloyd | 439/465 |
| 5,580,264 | A | 12/1996 | Aoyama et al. | 439/275 |
| 5,596,261 | A | 1/1997 | Suyama | 320/48 |

(List continued on next page.)

FOREIGN PATENT DOCUMENTS

| | | |
|---|---|---|
| EP | 0 299 797 | 1/1989 |
| EP | 0 546 753 A1 | 6/1993 |

(List continued on next page.)

*Primary Examiner*—Neil Abrams
*Assistant Examiner*—J. F. Duverne
(74) *Attorney, Agent, or Firm*—Finnegan, Henderson, Farabow, Garrett, & Dunner, L.L.P.

(57) ABSTRACT

A connector housing (14) has terminal accommodation chambers (13) in which terminals (12) connected to ends of electric wires (11) are accommodated. A soft sealing material (17) has terminal passing holes (15) through which the terminals (12) and the wires (11) are let to pass, and is assembled to a rear end portion (16) of the housing (14), from which the wires are let out and at which the soft sealing material (17) tight contacts on an inner wall (14*a*) of the housing (14) and outer circumferences of the wires (11), thereby sealing the terminal accommodation chambers (13). A pressing member (19) is inserted in the housing (14) to expand diameters of the terminal passing holes (15) of the soft sealing material (17) to diameters that allow the terminals (12) to pass through the terminal passing holes (15) without injuring inner walls (15*a*). of the terminal passing holes (15), and moved towards the terminal accommodation chambers (13) to press the soft sealing material (17) and to bring the soft sealing material (17) into tight contact with the inner wall (14*a*) of the housing (14) and outer circumferences of the wires (11).

8 Claims, 4 Drawing Sheets

U.S. PATENT DOCUMENTS

| | | | | |
|---|---|---|---|---|
| 5,613,868 | A | 3/1997 | Ohsumi et al. | |
| 5,645,451 | A | 7/1997 | Ohsumi et al. | 439/587 |
| 5,707,251 | A | 1/1998 | Sakai et al. | 439/589 |
| 5,709,563 | A | 1/1998 | Saito | 439/275 |
| 5,730,627 | A | 3/1998 | Okabe | 439/752 |
| 5,782,657 | A | 7/1998 | Wolla et al. | 439/595 |
| 5,803,773 | A | 9/1998 | Kashiyama et al. | 439/752 |
| 5,836,788 | A | 11/1998 | Torii | 439/587 |
| 5,860,834 | A | 1/1999 | Sugiyama | 439/595 |
| 5,931,699 | A | 8/1999 | Saito | 439/587 |
| 5,931,707 | A | 8/1999 | Ito | 439/752 |
| 5,947,774 | A | 9/1999 | Abe | 439/701 |
| 5,984,737 | A | 11/1999 | Nagano et al. | 439/752 |

FOREIGN PATENT DOCUMENTS

| | | | | |
|---|---|---|---|---|
| EP | 0 631 344 | A2 | 6/1994 | |
| EP | 0 691 710 | A2 | 1/1996 | |
| EP | 0700125 | A | 3/1996 | |
| EP | 0 778 636 | A1 | 6/1997 | |
| FR | 2415375 | | 8/1979 | |
| FR | 2753008 | | 3/1998 | |
| GB | 2 321 346 | A | 7/1998 | |
| GB | 2 321 347 | A | 7/1998 | |
| GB | 2 321 792 | A | 8/1998 | |
| GB | 2 321 802 | A | 8/1998 | |
| JP | 61-12621 | | 4/1986 | |
| JP | 62-188069 | | 11/1987 | |
| JP | 64-63282 | | 3/1989 | |
| JP | 4-49480 | | 4/1992 | |
| JP | 4-101380 | | 9/1992 | |
| JP | 5-152028 | | 6/1993 | |
| JP | 6-217412 | | 8/1994 | |
| JP | 6-295750 | | 10/1994 | |
| JP | 7-22079 | | 1/1995 | |
| JP | 7-122331 | | 5/1995 | |
| JP | 07201395 | | 8/1995 | |
| JP | 7-298450 | | 11/1995 | |
| JP | 07326424 | | 12/1995 | |
| JP | 8-31505 | | 2/1996 | H01R/13/52 |
| JP | 8-186901 | | 7/1996 | |
| JP | 9-45376 | | 2/1997 | |
| JP | 09082394 | | 3/1997 | |
| JP | 10-92478 | | 4/1998 | |
| JP | 2000-91020 | | 3/2000 | H01R/13/52 |
| WO | WO 92/15133 | | 9/1932 | |
| WO | WO 96/32760 | | 10/1996 | |
| WO | WO 97/36346 | | 10/1997 | |

WATERPROOF CONNECTOR AND WATERPROOFING METHOD

BACKGROUND OF THE INVENTION

1. Field of the Invention

The present invention relates to a waterproof connector of the type in which a connector housing has a terminal accommodation chamber sealed at a wire-outlet end with a "body of soft sealing material" (hereafter simply called "soft sealing material"), and to a waterproofing method for the waterproof connector.

2. Description of Relevant Art

There have been disclosed waterproof connectors of such a type in U.S. Pat. No. 4,662,692, Japanese Patent Application Laid-Open Publication No. 64-63282, and Japanese Utility Model Application Laid-Open Publication No. 4-101280.

A conventional waterproof connector of this type comprises a housing in which terminal accommodation chambers are formed, terminals connected to ends of electric wires and accommodated in the terminal accommodation chambers, and a soft sealing material for sealing the terminal accommodation chambers. The soft sealing material comprises a body of a gel, such as of silicon, and comes in tight contact with an inner wall of the housing and outer circumferences of the wires, thereby preventing water from invading the terminal accommodation chambers along the outer circumferences of the wires and the inner wall of the housing.

The soft sealing material is fitted at a wire-outlet side of the housing, and is prevented from slipping out of the housing by a retainer inserted and fixed in a rear end portion of the housing. The soft sealing. material has a plurality of slits formed therethrough for passing the terminals connected to the wires.

For assembling the terminals to the housing, first, the soft sealing material is inserted in the housing through an opening at the wire-outlet side, to be accommodated therein under pressure, thus tight contacting on an inner wall of the housing. Next, the retainer is inserted and fixed in the rear end portion of the housing, thereby preventing the soft sealing material from slipping off.

Then, the terminals are applied to the slits and forced therethrough, displacing sealing material on the way, and are inserted and fixed in the terminal accommodation chambers.

The wires follow the terminals, and extend through the slits. At this time, the soft sealing material is allowed to occupy gaps around the wires, and the slits close, contacting on the outer circumferences of the wires.

Water is thus prevented from invading the terminal accommodation chambers along the outer circumferences of the wires and the inner wall of the housing.

As the terminals are forced forward in the slits, they tend scrape the soft sealing material, carrying scraps of soft sealing material, which is an insulating material, to the terminal accommodation chambers. When the terminals are connected to mating terminals, such scraps intervene in between, constituting an obstacle to an ensured electrical contact.

As the soft sealing material is scraped by the terminals, the sealing nature also is deteriorated.

SUMMARY OF THE INVENTION

The present invention has been achieved with such points in view.

It therefore is an object of the present invention to provide a waterproof connector and a waterproofing method therefor, permitting the connector to be free of scrapes of a soft sealing material by a terminal, as well as of scraps of the soft sealing material carried in a terminal accommodation chamber.

To achieve the object, an aspect of the invention provides a waterproof connector which comprises a terminal connected to an electric wire, a housing having a chamber for accommodating the terminal and an outlet for passing the electric wire, a soft sealing body for sealing the outlet with a sealing configuration thereof the soft sealing body having a hole for the terminal to be inserted therethrough to the chamber, and in which the soft sealing body is deformed from an initial configuration thereof, where the hole has a sectional dimension smaller than a corresponding dimension of the terminal, via an intermediate configuration thereof, where the hole has a sectional dimension larger than the corresponding dimension of the terminal, to the sealing configuration, where the hole has an identical section to the electric wire.

According to the aspect of the invention, a sectional dimension of the hole in the initial configuration of the soft sealing body will constitute an obstacle if one tries to force through the hole the terminal which has a corresponding dimension larger than the sectional dimension. However, one can wait for the intermediate configuration on a way of deformation of the soft sealing body, where the hole has a sectional dimension larger than the corresponding dimension, and one can make use of this sectional dimension to let the terminal through the hole without scraping the soft sealing body nor carrying scraps thereof, before the soft sealing body has the sealing configuration in which the hole has an identical section to the electric wire, which wire is thus sealed.

The waterproof connector may preferably comprise an expanding member for expanding the hole to effect the deformation of the soft sealing material, or an insert forced into the soft sealing body to effect the deformation.

Further, to achieve the object, another aspect of the invention provides a waterproofing method for a waterproof connector including a terminal connected to an electric wire, a housing having a chamber for accommodating the terminal and an outlet for passing the electric wire, and a soft sealing body for sealing the outlet with a sealing configuration thereof, the soft sealing body having a hole for the terminal to be inserted therethrough to the cahmber. The waterproofing method comprises the step of deforming the soft sealing body from an initial configuration thereof, where the hole has a sectional dimension smaller than a corresponding dimenstion of the terminal, via an intermediate configuration thereof, where the hole has a sectional dimension larger than the corresponding dimension of the terminal, to the sealing configuration, where the hole has an identical section to the electric wire.

According to this aspect also, there can be achieved like effects to that aspect of the invention.

BRIEF DESCRIPTION OF THE ACCOMPANYING DRAWINGS

The above and further objects and novel features of the present invention will more fully appear from the following detailed description when the same is read in conjunction with the accompanying drawings, in which:

FIGS. 1A and 1B show a waterproof connector according to an embodiment of the invention, in which FIG. 1A is an exploded sectional view of the waterproof connector, and FIG. 1B is a longitudinal section in a state having a soft sealing material and a pressing member placed in a housing;

Figure 3:
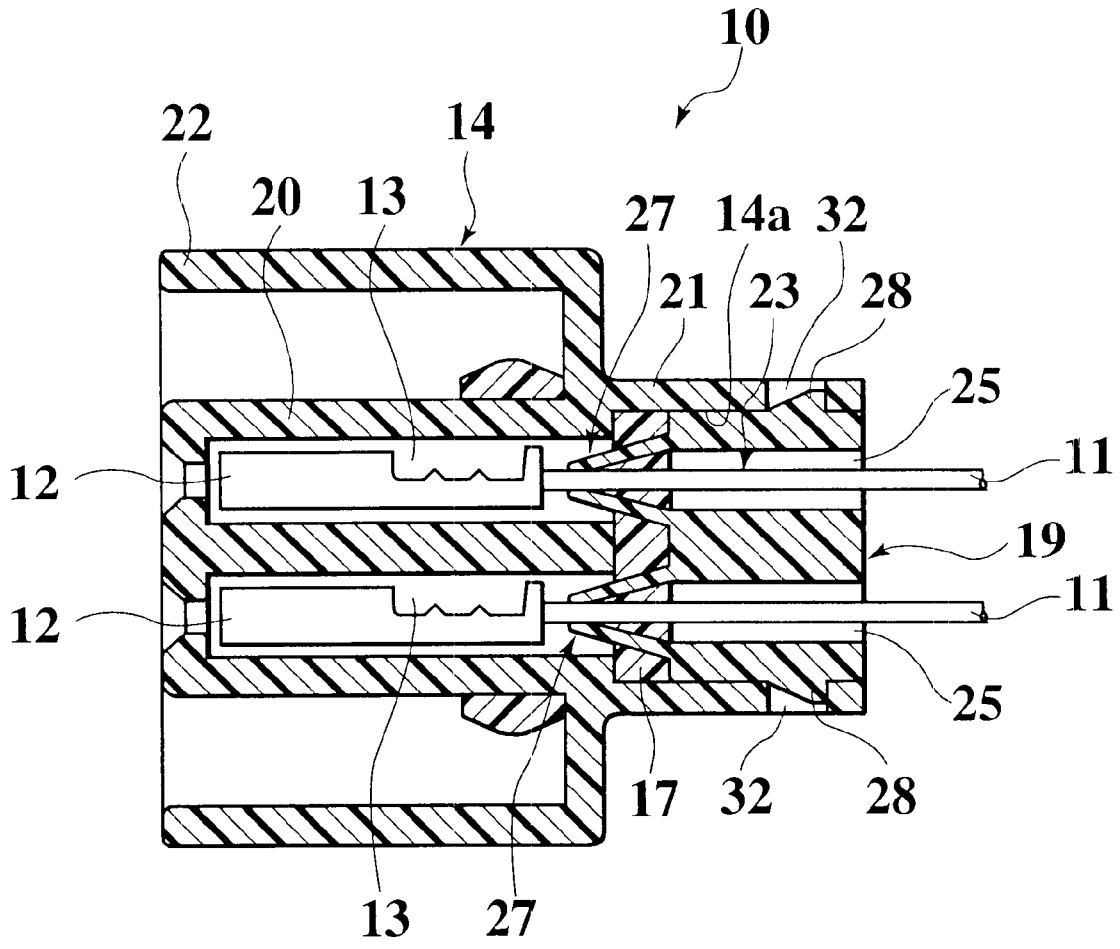
Figure 4A:
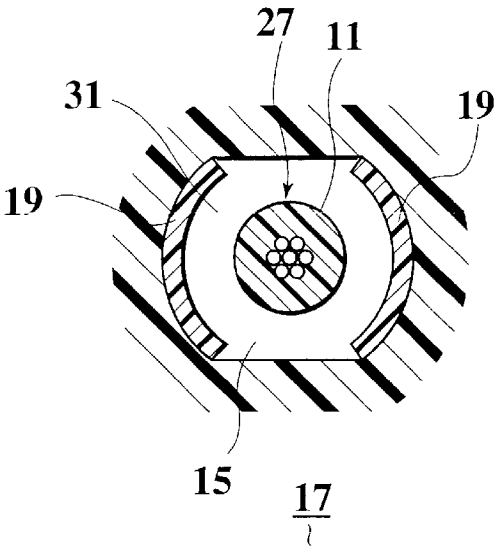
Figure 4B:
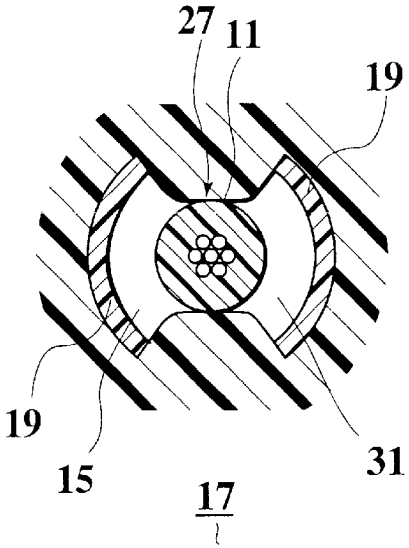
Figure 4C:
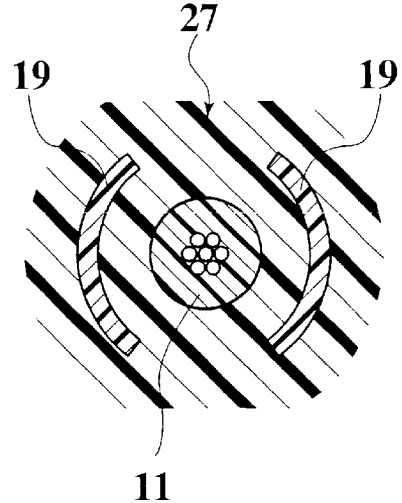

FIG. 3 is a longitudinal section of the waterproof connector in which terminals are accommodated in terminal accommodation chambers and the pressing member is inserted to end; and FIGS. 4A to 4C illustrate relationships between a pair of guide plates and the soft sealing material, in which FIG. 4A is a section before the pressing member moves toward a terminal accommodation chamber side, FIG. 4B is a section in a state when the pressing member is moving toward the terminal accommodation chamber side, and FIG. 4C is a section after the pressing member is moved to end toward the terminal accommodation chamber side, pressing the soft sealing material.

DETAILED DESCRIPTION OF THE PREFERRED EMBODIMENTS

There will be detailed below the preferred embodiments of the present invention with reference to the accompanying drawings. Like members are designated by like reference characters.

Figure 1A:
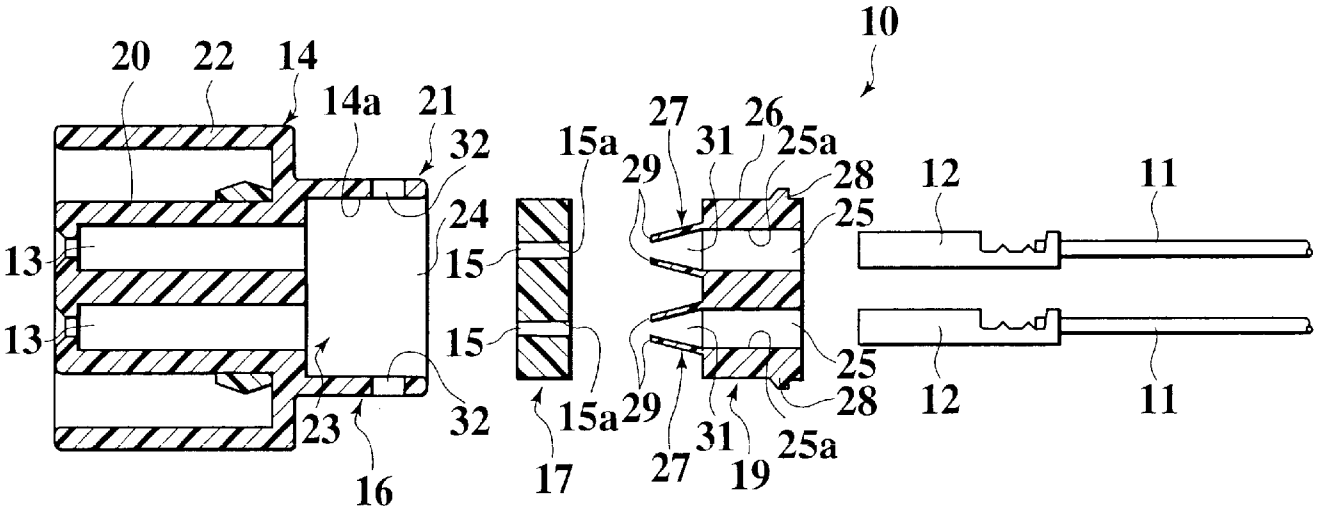
Figure 1B:
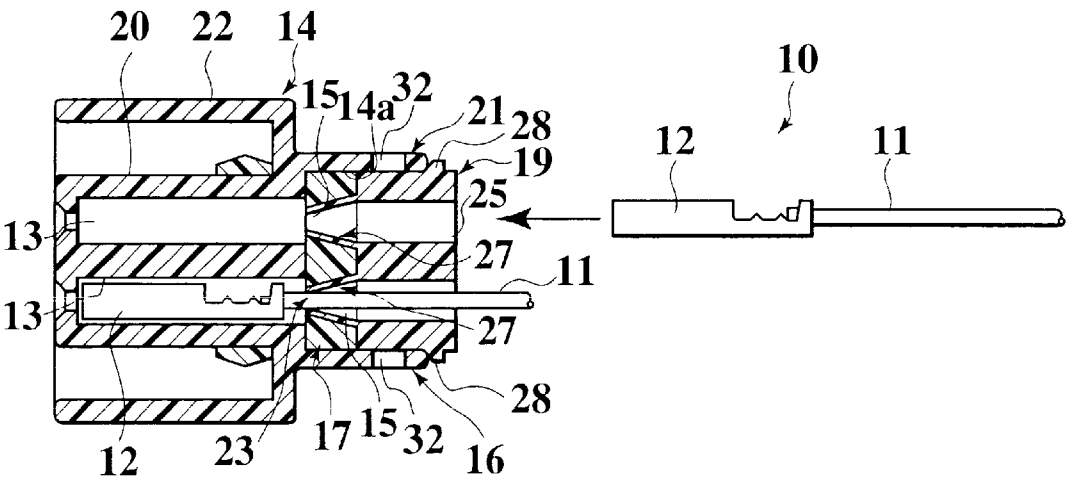
Figure 2:
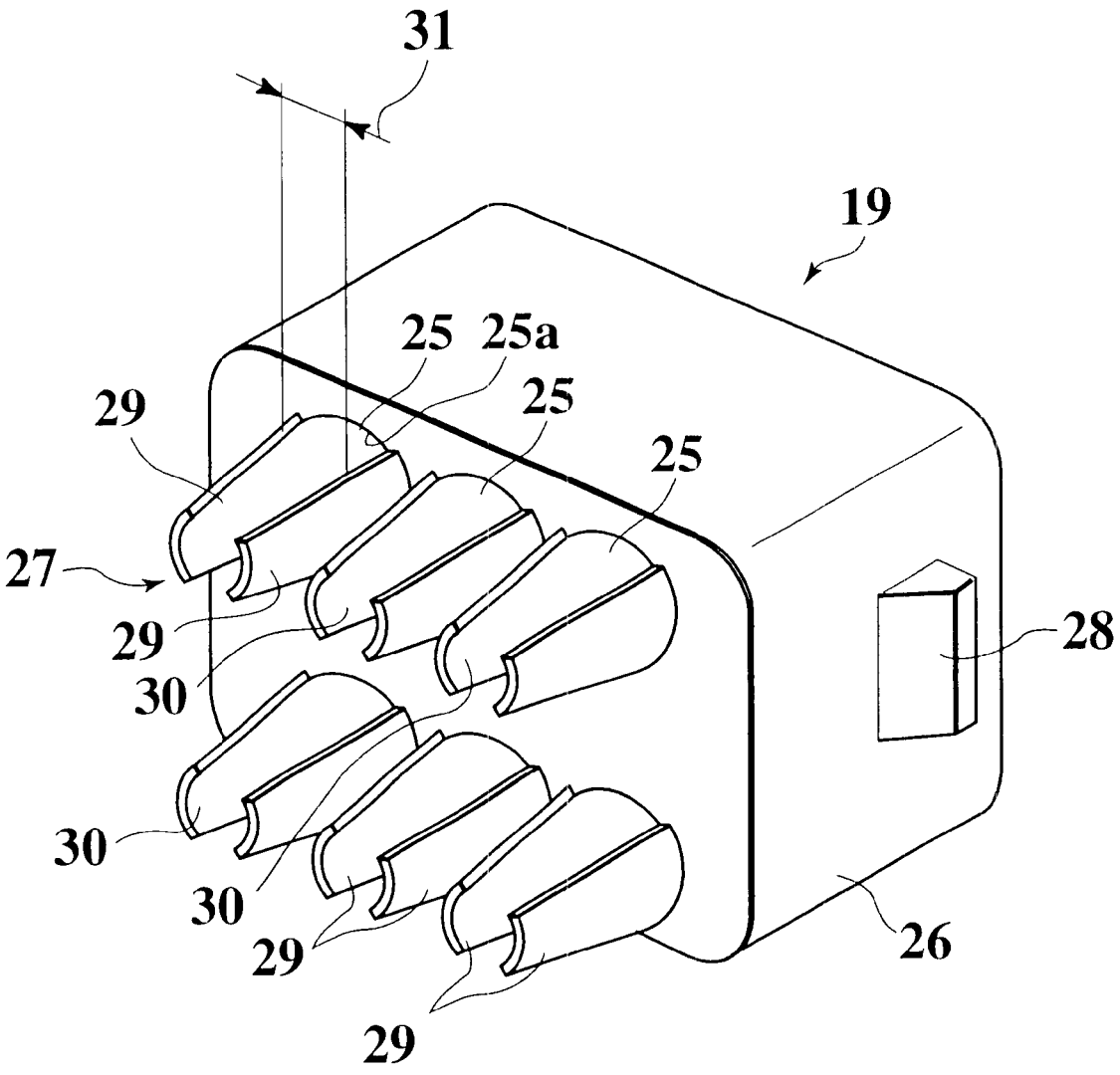
FIG. 2 is a perspective view of the pressing member.

FIG. 1A shows a waterproof connector 10, and FIG. 1B, a state when terminals 12 connected to ends of insulated electric wires 11 are inserted. FIG. 2 shows a pressing member 19, and FIG. 3, a state when the terminals 12 at the ends of the wires 11 are accommodated in a connector housing 14.

As shown in FIGS. 1A and 1B, the waterproof connector 10 comprises the housing 14 having terminal accommodation chambers 13 where the terminals 12 connected to the ends of the wires 11 are accommodated, and a soft sealing material 17 having terminal passing holes 15 through which the terminals 12 and the wires 11 pass and assembled to a rear end portion of the housing 14 at a wire draw-out side thereof to come in tight contact (adhering, as used herein) with an inner wall 14*a* of the housing 14 and outer circumferences of the wires 11, thereby sealing insides of the terminal accommodation chambers 13. The waterproof connector 10 is provided with a pressing member 19 assembled to the housing 14 for enlarging each terminal passing hole 15 of the soft sealing material 17 to such a diameter that each terminal 12 is insertable into the hole 15 without injuring an inner wall 15a of the terminal passing hole 15 and for pressing the soft sealing material 17 by movement towards the side of the terminal accommodation chambers 13 to bring the soft sealing material 17 into tight contact with the inner wall 14a of the housing 14 and the circumference of each wire 11.

The housing 14 comprises a body portion 20, a base portion 21 formed integrally with the body portion 20, and a water-proof hood portion 22 provided on an outer circumference of the body portion 20. The terminal accommodation chambers 13 are formed in a two-staged manner inside the body portion 20. Also, the base portion 21 is provided with a sealing portion 23 assembled with the soft sealing material 17 and the pressing member 19. An assembling space 24 surrounded by the inner wall 14*a* is formed in the sealing portion 23.

The soft sealing material 17 is made of a gel, such as of silicon, a low hardness rubber, or elastomer, or other rheological material, and has the terminal passing holes 15, through which the terminals 12 and the wires 11 are made to pass, formed in a two-staged manner. In a state where the soft sealing material 17 is assembled in the sealing portion 23, the terminal accommodation chambers 13 and the terminal passing holes 15 communicate with each other. The pressing member 19 is assembled in the sealing portion 23 at a side opposite to the terminal accommodation chambers 13 through the soft sealing material 17.

The pressing member 19 comprises a body 26 having passing holes 25 through which the terminals 12 are made to pass, guiding/enlarging portions 27 formed so as to project from opening edge portions 25*a* of the passing holes 25 and inserted into the terminal passing holes 15 of the soft sealing material 17, thereby enlarging the terminal passing holes 15, and engaging projections 28 engaged with engaging holes 32 formed on the inner wall 14*a* of the housing 14 to hold the soft sealing material 17 while the soft sealing material 17 is being pressed.

Each guiding/enlarging portion 27 comprises a pair of guide plates 29, 29 formed in an opposing manner so as to project from an opening edge portion 25*a* of the passing hole 25, each having an arc-shaped cross section, and a guide space 30 formed between the pair of guide plates 29, 29 is gradually tapered towards its tip end. Also, clearances 31, 31 are formed so as to oppose to each other between the pair of guide plates 29, 29.

Next, a waterproofing method using the waterproof connector 10 will be described.

From the state shown in FIG. 1A, as shown in FIG. 1B, after the soft sealing material 17 is assembled into the sealing portion 23 at the rear end portion of the housing 14, the pressing member 19 is assembled into the assembling space 24 of the sealing portion 23. In assembling of the pressing member 19 into the sealing portion 23, the pair of guide plates 29, 29 are inserted into the terminal passing hole 15 of the soft sealing material 17 to expand the same, as shown in FIG. 4A. In this state, the terminals 12 at the ends of the wires 11 are made to pass through the passing holes 25 of the pressing member 19 and are further made to pass through the terminal passing holes 15. In this case, as each terminal passing hole 15 is enlarged by the pair of guide plates 29, 29 and portions of the inner circumference of the terminal passing hole 15 are covered with the pair of guide plates 29, 29, the terminal 12 is prevented from sliding on the inner wall 15*a* of the terminal passing hole 15, so that the inner wall 15*a* of the terminal passing hole 15 is prevented from being injured by the terminal 12.

Then, before the pressing member 19 is moved towards the side of the terminal accommodation chambers 13, the terminals 12 which have been made to pass through terminal passing holes 15 are accommodated in the terminal accommodation chambers 13. According to the movement of the pressing member 19 towards the side of the terminal accommodation chambers 13, the soft sealing material 17 is gradually pressed to come in tight contact with the inner wall 14*a* of the housing 14 and to flow into the inside of the pair of guide plates 29, 29 (the guide space 30) from the clearances 31, 31 between the pair of guide plates 29, 29 to be filled around the wire 11, as shown in FIG. 4B. As the pressing member 19 is further moved towards the side of the terminal accommodation chambers 13, the engaging projections 28 are engaged with the engaging holes 32, so that the soft sealing material 17 is maintained in a pressed state by the pressing member 19. In this case, the distal portions of the pair of guide plates 29, 29 project slightly in the terminal accommodating portion 13.

Also, in this state, the soft sealing material 17 flowing in between the pair of guide plates 29, 29 to be filled in the guide space 30 comes in tight contact with the outer circumference of the wire 11. The terminal accommodation chamber 13 is thus sealed by the soft sealing material 17.

As the terminal 12 is made to pass through the terminal passing hole 15 in the state where the terminal passing hole 15 is enlarged by the pair of guide plates 29, 29 and the portions of the terminal passing hole 15 are covered with the pair of guide plates 29, 29, the inner wall of the terminal passing hole 15 is prevented from being injured by the terminal 12, and the soft sealing material 17 is prevented from adhering to the terminal 12. The soft sealing material 17 which is an insulating material is not intervened between the terminal 12 and a mating terminal, when the terminals are connected to each other, and an electrical reliability in connection is improved. The soft sealing material 17 is prevented from being scraped off by the terminal 12, and a sealing performance of the soft sealing material 17 is secured.

As the soft sealing material 17 easily flows into the guide space 30 from the clearances 31 between the pair of guide plates 29, 29, the soft sealing material 17 can come in tight contact with the outer circumference of the wire 11, thereby improve the sealing performance.

According to the embodiment described, as the pressing member is assembled to the rear end portion of the housing and the diameter of the terminal passing hole of the soft sealing material is enlarged, even when the terminal at the end portion of the wire is made to pass through the terminal passing hole, the terminal does not injure the inner wall of the terminal passing hole and the soft sealing material does not adhere to the terminal. In connection of the terminal to a mating terminal, as the soft sealing material which is an insulating material is not intervened between the terminal and the mating terminal, the electrical reliability can be enhanced.

Also, as the soft sealing material is prevented from being injured by the terminal, the sealing performance by the soft sealing material can be secured.

When the pressing member is assembled into the rear end portion of the housing in the state where the soft sealing material is assembled into the housing, the guiding/enlarging portion is inserted in the terminal passing hole of the soft sealing material and the diameter of the terminal passing hole can easily be enlarged.

Also, when the terminal at the end of the wire is made to pass through the passing hole of the pressing member and is made to pass through the terminal passing hole of the soft sealing material to be accommodated in the terminal accommodation chamber in the state where the diameter of the terminal passing hole is being enlarged, the terminal does not injure the inner wall of the terminal passing hole and the soft sealing material does not adhere to the terminal.

As the soft sealing material flows into the guide space from the clearance between the pair of guide plates when the soft sealing material is pressed, the soft sealing material can be brought into tight contact with the outer circumference of the wire. The sealing performance can thus be improved.

After the soft sealing material is assembled into the rear end portion of the housing, the pressing member is fitted to the rear end portion, so that the terminal passing hole can be enlarged to such a diameter that the terminal is insertable into the terminal passing hole without injuring the inner wall of the terminal passing hole. In this state, the terminal and the wire are made to pass through the passing hole of the pressing member and the terminal passing hole, thereby accommodating the terminal in the terminal accommodation chamber and the pressing member is moved towards the side of the terminal accommodation chamber to press the soft sealing material, so that the soft sealing material can be brought into tight contact with the inner wall of the housing and the outer circumference of the wire.

According to an aspect of the embodiment, a waterproof connector comprises a housing having a terminal accommodation chamber in which a terminal at an end of a wire is accommodated, and a soft sealing material having a terminal passing hole through which the terminal and the wire are made to pass and assembled to a rear end portion of the housing through which the wire is drawn out to come in tight contact with an inner wall of the housing and an outer circumference of the wire, thereby sealing inside of the terminal accommodation chamber, wherein the waterproof connector further comprises a pressing member assembled to the housing to expand the diameter of the terminal passing hole of the soft sealing material to a diameter allowing the terminal to pass through the terminal passing hole without injuring an inner wall of the terminal passing hole and moved towards the terminal accommodation chamber to press the soft sealing material and to bring the soft sealing material into tight contact with the inner wall of the housing and the outer circumference of the wire.

According to this aspect, a pressing member is assembled to a rear end portion of a housing to expand the diameter of a terminal passing hole of a soft sealing material, so that, even when a terminal at an end of a wire is made to pass through the terminal passing hole, the terminal is prevented from injuring an inner wall of the terminal passing hole and the soft sealing material is prevented from adhering to the terminal. Also, after the terminal which has been made to pass through the terminal passing hole is accommodated in a terminal accommodation chamber, the pressing member is moved towards the soft sealing material side to press the soft sealing material. Thereby the soft sealing material comes in tight contact with an inner wall of the housing and an outer circumference of the wire.

According to another aspect, the pressing member comprises a body having a passing hole portion through which the terminal is made to pass, a guiding and diameter-enlarging portion provided in a projecting manner from an opening edge portion of the passing hole portion of the body to be inserted into the terminal passing hole of the soft sealing material to expand the diameter of the terminal passing hole, and an engaging projection engaged with an engaging hole of the housing to hold a state where the soft sealing material is being pressed.

According to this aspect, with assembling of a soft sealing material to a housing, when a pressing member is assembled to a rear end portion of the housing, a guiding and diameter-enlarging portion is inserted into a terminal passing hole of the soft sealing material to expand the diameter of the terminal passing hole. In this state, a terminal at an end of a wire is made to pass through a passing hole of the pressing member and then is made to pass through the terminal passing hole of the soft sealing material to be accommodated in a terminal accommodation chamber. At this time, the terminal is prevented from injuring an inner wall of the terminal passing hole and the soft sealing material is prevented from adhering to the terminal.

After the terminal is accommodated in the terminal accommodation chamber, the pressing member is moved towards the terminal accommodation chamber to press the soft sealing material. As the soft sealing material is pressed, the soft sealing material comes in tight contact with an inner wall of the housing and an outer circumference of the wire.

According to another aspect, the guiding and diameter-enlarging portion comprises a pair of guide plates with an arc-shaped section projected from an opening edge portion of the passing hole to be opposed to each other, and a guide space formed between the pair of guide plates is gradually tapered towards a tip end.

According to this aspect, with assembling a soft sealing material to a housing, when a pressing member is assembled to a rear end portion of the housing, a pair of guide plates are inserted into a terminal passing hole of the soft sealing material to expand the diameter of the terminal passing hole. In this state, a terminal at an end of a wire is made to pass through the terminal passing hole to be accommodated in a terminal accommodation chamber. After the terminal is accommodated in the terminal accommodation chamber, the pressing member is moved towards the terminal accommodation chamber to press the soft sealing material. When the soft sealing material is pressed, the soft sealing material flows into a space between the pair of guide plates from a gap between the pair of guide plates to come in tight contact with an outer circumference of a wire and to come in tight contact with an inner wall of the housing.

According to another aspect of the embodiment, a waterproofing method using a waterproof connector comprises the steps of: fitting the pressing member to the rear end portion of the housing after the soft sealing material is assembled to the rear end portion of the housing; making the terminal and the wire pass through a passing hole of the pressing member and the terminal passing hole to accommodate the terminal in the terminal accommodation chamber in a state where the diameter of the terminal passing hole is enlarged to a diameter allowing the terminal to pass through the terminal passing hole without injuring the inner wall of the terminal passing hole; and moving the pressing member towards the terminal accommodation chamber to press the soft sealing material and to bring the soft sealing material into tight contact with the inner wall of the housing and the outer circumference of the wire.

According to this aspect, after a soft sealing material is assembled to a rear end portion of a housing, a pressing member is fitted to the rear end portion of the housing. Owing to fitting of the pressing member, the diameter of a terminal passing hole is enlarged to a diameter allowing the terminal to pass through the terminal passing hole without injuring an inner wall of the terminal passing hole. In this state, the terminal and a wire are made to pass through a passing hole of the pressing member and the terminal passing hole of the soft sealing material and the terminal is accommodated in a terminal accommodation chamber. Further, the pressing member is moved towards the terminal accommodation chamber side to press the soft sealing material, thereby bring the soft sealing material into tight contact with an inner wall of the housing and an outer circumference of the wire.

Incidentally, in the embodiment described, respective sectional configurations of holes 15 in the soft sealing material 19, as well as between sections of guide plates 29, are considered to be defined by a circle or a combination of a circle and a pair of opposing chords thereof (see FIG. 4A) for comprehension, and associated dimensions are referenced in the term of a diameter of the circle. However, they may have an arbitrary form defined by a variety of dimensions to be different in dependence on a local position in and an orientation of the soft sealing material 17 and/or the pressing member 19.

In this respect, an aspect of the embodiment provides a waterproof connector which comprises a terminal 12 connected to an electric wire 11, a housing 14 having a chamber 13 for accommodating the terminal and an outlet 23 for passing the electric wire, a soft sealing body 17 for sealing the outlet with a sealing configuration thereof (FIG. 4C), the soft sealing body having a hole 15 for the terminal to be inserted therethrough to the cahmber, and in which the soft sealing body is deformed from an initial configuration thereof (FIG. 1A), where the hole has a sectional dimension smaller than a corresponding dimenstion of the terminal, via an intermediate configuration thereof (FIGS. 4A and 4B), where the hole has a sectional dimension larger than the corresponding dimension of the terminal, to the sealing configuration, where the hole has an identical section to the electric wire.

While a preferred embodiment of the present invention has been described using specific terms, such description is for illustrative purposes, and it is to be understood that changes and variations may be made without departing from the spirit or scope of the following claims.

What is claimed is:

1. A waterproof connector comprising:

a terminal connected to a chamber for accommodating the terminal and a deformable viscous sealing body for sealing the outlet with a sealing configuration thereof, the deformable viscous sealing body having a hole for the terminal to be inserted therethrough to the chamber; and a structure configured to engage the hole in the viscous sealing body and deform the hole from an initial configuration thereof, where the hole has a sectional dimension smaller than a corresponding dimension of the terminal, via an intermediate configuration thereof, wherein the hole has a sectional dimension larger than the corresponding dimension of the terminal, to the sealing configuration, where the hole has an identical section to the electric wire;

wherein said structure comprises an insert in the sealing body, and wherein the viscous sealing body is deformed by contact with the structure such that a portion of the sealing body is located between the insert and the wire, and wherein another portion of the sealing body surrounds the insert.

2. The waterproof connector of claim 1, wherein the structure comprises an expanding member for expanding the hole.

3. A waterproofing method for a waterproof connector including a terminal connected to an electric wire, a housing having a chamber for accommodating the terminal and an outlet for passing the electric wire, and a deformable viscous sealing body for sealing the outlet with a sealing configuration thereof, the deformable sealing body having a hole for the terminal to be inserted therethrough to the chamber, the waterproofing method comprising the steps of:

providing a structure comprising an insert;

engaging the hole of the deformable viscous sealing body with said structure and deforming the deformable viscous sealing body from an initial configuration thereof, where the hole has a sectional dimension smaller than a corresponding dimension of the terminal, via an intermediate configuration thereof, where the hole has a sectional dimension larger than the corresponding dimension of the terminal, to the sealing configuration, where the hole has an identical section to the electric wire;

wherein the step of engaging the hole of the sealing body with said structure includes forcing the insert into the hole, and wherein deforming the hole to the sealing configuration includes causing a portion of the deformable viscous sealing body to flow between the insert and the wire.

4. A waterproof connector comprising:

a housing having a terminal accommodation chamber in which a terminal at an end of a wire is accommodated;

a deformable viscous sealing material configured to deform by flowing upon the application of pressure and having a terminal passing hole through which the terminal and the wire are made to pass, and assembled to a rear end portion of the housing from which the wire is drawn out to come in tight contact with an inner wall of the housing and an outer circumference of the wire, thereby sealing an inside of the terminal accommodation chamber;

a pressing member engaging the terminal passing hole to expand the diameter of the terminal passing hole of the deformable viscous sealing material to a diameter allowing the terminal to pass through the terminal passing hole without injuring the inner wall of the terminal passing hole, the pressing member configured to move towards the terminal accommodation chamber to press the deformable viscous sealing material and to bring the deformable viscous sealing material into tight contact with the inner wall of the housing and the outer circumference of the wire, wherein said pressing member comprises an insert in the sealing material.

5. The waterproof connector of claim 4, wherein the pressing member comprises:

a body having a passing hole portion through which the terminal is made to pass;

a guiding and diameter-enlarging portion projecting from an opening edge portion of the passing hole portion and configured to be inserted into the terminal passing hole of the deformable viscous sealing material to expand the diameter of the terminal passing hole; and an engaging projection engaged with an engaging hole of the housing to hold a state where the deformable viscous sealing material is being pressed.

6. The waterproof connector of claim 5, wherein the guiding and diameter-enlarging portion comprises a pair of guide plates with an arc-shaped section which project from the opening edge portion of the passing hole and are opposed to each other, and wherein a guide space formed between the pair of guide plates gradually tapers towards a tip end thereof.

7. A waterproofing method using a waterproof connector according to claim 4, comprising the steps of:

providing a pressing member comprising an insert;

fitting the pressing member to the rear end portion of the housing after the deformable viscous sealing material is assembled to the rear end portion of the housing;

making the terminal and the wire pass through a passing hole of the pressing member and the terminal passing hole to accommodate the terminal in the terminal accommodation chamber in a state where the diameter of the terminal passing hole is enlarged to a diameter allowing the terminal to pass through the terminal passing hole without injury to the inner wall of the terminal passing hole;

wherein the step of making the terminal and wire pass through a passing hole of the pressing member and the terminal passing hole includes forcing the insert into the terminal passing hole; and moving the pressing member towards the terminal accommodation chamber to press the deformable viscous sealing material and to cause the deformable sealing material to flow into tight contact with the inner wall of the housing and the outer circumference of the wire.

8. A waterproof connector comprising:

a housing having a terminal accommodation chamber in which a terminal at an end of a wire is accommodated a deformable sealing material having a terminal passing hole through which the terminal and the wire are made to pass, and assembled to a rear end portion of the housing from which the wire is drawn out to come in tight contact with an inner wall of the housing and an outer circumference of the wire, thereby sealing an inside of the terminal accommodation chamber; and a pressing member engaging the terminal passing hole to expand the diameter of the terminal passing hole of the deformable sealing material to a diameter allowing the terminal to pass through the terminal passing hole without injuring the inner wall of the terminal passing hole, the pressing member configured to move towards the terminal accommodation chamber to press the deformable sealing material and to bring the deformable sealing material into tight contact with the inner wall of the housing and the outer circumference of the wire, the pressing member comprising:

a body having a passing hole portion through which the terminal is made to pass;

a guiding and diameter-enlarging portion projecting from an opening edge portion of the passing hole portion and configured to be inserted into the terminal passing hole of the deformable sealing material to expand the diameter of the terminal passing hole; and an engaging projection engaged with an engaging hole of the housing to hold a state where the deformable sealing material is being pressed, wherein the guiding and diameter-enlarging portion comprises a pair of guide plates with an arc-shaped section which project from the opening edge portion of the passing hole and are opposed to each other, and wherein a guide space formed between the pair of guide plates gradually tapers towards a tip end thereof.

* * * * *

UNITED STATES PATENT AND TRADEMARK OFFICE

CERTIFICATE OF CORRECTION

PATENT NO. : 6,398,585 B1
DATED : June 4, 2002
INVENTOR(S) : Masaru Fukuda

It is certified that error appears in the above-identified patent and that said Letters Patent is hereby corrected as shown below:

Title page,
Item [57], ABSTRACT,
Line 15, after "inner walls (15a)", delete the period.

Column 8,
Line 22, after "terminal and", insert -- an outlet for passing the electric wire; --.

Column 10,
Line 19, "accommodated" should read -- accommodated; --.

Signed and Sealed this

Fifteenth Day of October, 2002

*Attest:*

*Attesting Officer*

JAMES E. ROGAN
*Director of the United States Patent and Trademark Office*